US011717021B2

(12) United States Patent
Pontes et al.

(10) Patent No.: US 11,717,021 B2
(45) Date of Patent: Aug. 8, 2023

(54) METHOD OF EXTRACTING VOLATILE COMPOUNDS FROM TOBACCO MATERIAL

(71) Applicant: BRITISH AMERICAN TOBACCO (INVESTMENTS) LIMITED, London (GB)

(72) Inventors: Oscar Francisco Swenson Pontes, Rio de Janeiro (BR); Eduardo José Faria Miranda, Rio de Janeiro (BR); Luis Gustavo Teixeira dos Reis, Rio de Janeiro (BR)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 493 days.

(21) Appl. No.: 16/608,278

(22) PCT Filed: Apr. 26, 2018

(86) PCT No.: PCT/GB2018/051098
§ 371 (c)(1),
(2) Date: Oct. 25, 2019

(87) PCT Pub. No.: WO2018/197879
PCT Pub. Date: Nov. 1, 2018

(65) Prior Publication Data

US 2020/0187551 A1 Jun. 18, 2020

(30) Foreign Application Priority Data

Apr. 28, 2017 (GB) ..... 1706778

(51) Int. Cl.
*A24B 15/24* (2006.01)
*A24B 15/26* (2006.01)
*A24B 15/12* (2006.01)

(52) U.S. Cl.
CPC ..... *A24B 15/241* (2013.01); *A24B 15/26* (2013.01); *A24B 15/12* (2013.01)

(58) Field of Classification Search
CPC ..... A24B 15/26
See application file for complete search history.

(56) References Cited

U.S. PATENT DOCUMENTS 3,424,171 A 1/1969 Rooker
9,254,001 B2 2/2016 Hege Byrd et al.
(Continued)

FOREIGN PATENT DOCUMENTS

CN 101661022 A 3/2010
CN 102564839 A 7/2012
(Continued)

OTHER PUBLICATIONS

Liu et al., "Studies on the free and glycosidically bound aroma components of tobacco during the casing process", Bull. Spec. CORESTA Congress, Brighton, p. 179, ST33, 1998.
(Continued)

*Primary Examiner* — Michael J Felton
(74) *Attorney, Agent, or Firm* — McKee, Voorhees & Sease, PLC

(57) ABSTRACT

There is provided a method of extracting one or more volatile compounds of interest from tobacco material, the method comprising the steps of: i) providing tobacco material; ii) subjecting the tobacco material to steam distillation; and iii) extracting one or more volatile compounds of interest from the tobacco material with a solvent; wherein distillation step (ii) and extraction step (iii) are carried out simultaneously and at a pH of no greater than 2, and wherein the period during which both the distillation step (ii) and the extraction step (iii) are carried out is from about 8 to about 20 hours.

10 Claims, 10 Drawing Sheets

(56) References Cited

U.S. PATENT DOCUMENTS

| | | | | |
|---|---|---|---|---|
| 2012/0192882 | A1 | 8/2012 | Dube et al. | |
| 2015/0344456 | A1* | 12/2015 | Dull | A61P 25/28 514/343 |

FOREIGN PATENT DOCUMENTS

| | | | |
|---|---|---|---|
| CN | 102905565 | A | 1/2013 |
| CN | 103226136 | A | 7/2013 |
| CN | 104151140 | A | 11/2014 |
| CN | 103235060 | B | 4/2015 |
| CN | 106290663 | A * | 1/2017 |
| GB | 1303009 | | 1/1973 |
| JP | 59183680 | A | 10/1984 |
| WO | 2011146264 | A2 | 11/2011 |
| WO | 2018197879 | A1 | 11/2018 |

OTHER PUBLICATIONS

National Intellectual Property Administration, P R. China, "First Office Action", issued in connection to Application No. 201880028038.6, 13 pages, dated May 7, 2021.

Hu et al. "Investigation of two-step simultaneous distillation extraction for isolation free and bound volatiles", Proceedings of 2005 Symposium on Tobacco Chemistry of China Tobacco Society Industrial Committee, pp. 525-531, Nov. 30, 2005.

Zhenfeng et al., "Studies on the content of glycosides aroma precursors in tobacco leaves during flue-curing", Proceedings of 2005 Symposium on Tobacco Chemistry of China Tobacco Society Industrial Committee, pp. 262-265, Dec. 31, 2005.

Cai et al., "Analysis of free and bound volatiles by gas chromatography and gas chromatography—mass spectrometry in uncased and cased tobaccos", Journal of Chromatography A, vol. 947, pp. 267-275, 2002.

Chaintreau, Alain, "Simultaneous distillation—extraction: from birth to maturity-reivew", Flavour and Fragrance Journal, vol. 16, pp. 136-148, 2001.

Eikani et al., "Recovery of water-soluble constituents of rose oil using simultaneous distillation-extraction", Flavour and Fragrance Journal, vol. 20, pp. 555-558, 2005.

Grob et al., "The Influence of the Syringe Needle on the Precision and Accuracy of Vaporizing GC Injections", Journal of High Resolution Chromatography & Chromatography Communications, pp. 15-21, Jan. 1979.

Hu et al., "Two-Step Simultaneous Distillation and Solvent Extraction for Isolation Both Free and Bound Aroma in Tobacco", Annali di Chimica, vol. 96, 8 pages, 2006.

British American Tobacco (Investments) Limited, "The International Search Report and the Written Opinion of the International Searching Authority, or the Declaration", in connection with PCT/GB2018/051098 filed Apr. 26, 2018, 16 pages, dated Oct. 2, 2018.

Kim et al., "Influence of Isolation Method on the Composition of Apricot (*Prunus armeniaca* var. ansu Max.) Flavor", Korean J. Food Sci. Technol., vol. 22, No. 5, pp. 543-548, 1990.

Leffingwell, J.C., "Basic Chemical Constituents of Tobacco Leaf and Differences among Tobacco Types", Tobacco: Production, Chemistry, and Technology, Chapter 8, pp. 265-284, 1999.

Likens et al., "Detection of Certain Hop Oil Constituents in Brewing Products", Proceedings, Annual Meeting—American Society of Brewing Chemists, vol. 22:1, pp. 5-13, 1964.

Luo et al., "Optimization Extraction Process of Aroma Components in Tobacco", Journal of Chromatographic Science, vol. 51, pp. 250-257, 2013.

Peng et al., "Comparison of different extraction methods: steam distillation, simultaneous distillation and extraction and headspace co-distillation, used for the analysis of the volatile components in aged flue-cured tobacco leaves", Journal of Chromatography A, vol. 1040, pp. 1-17, Mar. 30, 2004.

Schultz et al., "Isolation of Volatile Components from a Model System", J. Agric. Food Chem., vol. 25, No. 3, 4 pages, 1977.

Sun et al., "Differentiation of flue-cured tobacco leaves in different positions based on neutral volatiles with principal component analysis (PCA)", Eur. Food Res. Technol., vol. 235, pp. 745-752, Apr. 23, 2012.

Vinutha et al., "Glycosides—Flavor Enhancers in Tobacco Smoke", https://www.coresta.org/sites/default/files/abstracts/2010_TSRC68_Palani.pdf, dated Jan. 2010, 24 pages, retrieved Sep. 19, 2018.

Yin et al., "GC-MS analysis of essential oil of Paeonia suffruticosa Andrews from ZhaoFen and RouFurong flowers in China", Natural Science, vol. 4, No. 8, pp. 552-554, Jul. 30, 2012.

Xu et al., "Comparison of volatile and semivolatile compounds from commercial cigarette by supercritical fluid exliaction and simultaneous distillation extraction", Journal of Zhejiang University Science, vol. 5(12), pp. 1528-1532, Mar. 16, 2004.

Wei et al., "An integrated simultaneous distillation-extraction apparatus for the extraction of essential oils from herb materials and its application in Flos Magnoliae", Biomedical Chromatography, vol. 24, pp. 289-293, 2010.

Zhang et al., "Extraction of essential oil from discarded tobacco leaves by solvent extraction and steam distillation, and identification of its chemical composition", Industrial Crops and Production, vol. 39, pp. 162-169, Feb. 18, 2012.

Zhong et al., "Comparison of simultaneous distillation extraction and solid-phase micro-extraction for determination of volatile constituents in tobacco flavor", J. Cent. South Univ. Technol., vol. 12, No. 5, pp. 546-551, Oct. 2005.

* cited by examiner

METHOD OF EXTRACTING VOLATILE COMPOUNDS FROM TOBACCO MATERIAL

FIELD

The present invention relates to a method of extracting one or more volatile compounds of interest from tobacco material, a tobacco extract obtainable or obtained by said method, a tobacco product comprising said tobacco extract, a method of preparing said tobacco product, and the use of said tobacco extract.

BACKGROUND

Popular smoking articles, such as cigarettes, have a substantially cylindrical rod shaped structure and include a column of a smokable material such as tobacco (e.g., in cut filler form) surrounded by a paper wrapper thereby forming a so-called "tobacco rod". Normally, a cigarette has a cylindrical filter element aligned in an end-to-end relationship with the tobacco rod and the filter element is attached to one end of the tobacco rod using a circumscribing wrapping material known as tipping paper. A cigarette is employed by a smoker by lighting one end of the cigarette and burning the tobacco rod. The smoker then receives a mainstream smoke into his/her mouth by drawing on the opposite end (e.g., the filter end) of the cigarette.

New smoking articles are also being designed and launched in the market as new generation products. These can be classified into three main groups and may be referred to as "vaping articles":

1. Electronic devices;
2. Heating devices; and,
3. Hybrid devices.

Hybrid devices are a combination of an electronic and heating device.

Through the years, various treatment methods and additives have been proposed for altering the overall character or nature of tobacco materials utilized in tobacco products. For example, additives or treatment processes have been utilized to alter the chemistry or sensory properties of the tobacco material in cigarettes or in the case of smoking or vaping tobacco materials, to alter the chemistry or sensory properties of mainstream smoke/aerosol generated by smoking/vaping articles including the tobacco material.

The sensory attributes can for instance be enhanced by incorporating flavouring materials into various components of the cigarette or smoking/vaping article. Exemplary flavouring additives include menthol and products of Maillard reactions, such as pyrazines, amino sugars, and Amadori compounds.

There is, however, still a need in the art for compositions suitable for addition to tobacco products (which may include smoking and/or vaping products) to introduce desired sensory characteristics. In particular, it would be desirable to provide a method for efficient extraction and isolation of such compositions.

SUMMARY

In accordance with some embodiments described herein, a method of extracting one or more volatile compounds of interest from tobacco material is provided, the method comprising the steps of:

i) providing tobacco material;

ii) subjecting the tobacco material to steam distillation; and iii) extracting one or more volatile compounds of interest from the tobacco material with a solvent;

wherein distillation step (ii) and extraction step (iii) are carried out simultaneously and at a pH of no greater than 2, and wherein the period during which both the distillation step (ii) and the extraction step (iii) are carried out is from about 8 to about 20 hours.

In accordance with some embodiments described herein, a tobacco extract obtainable or obtained by a method as defined herein is provided, wherein the tobacco extract comprises one or more volatile compounds of interest in an amount of at least about 75% by weight of the tobacco extract.

In accordance with some embodiments described herein, a tobacco product is provided, the tobacco product comprising a tobacco extract as defined herein.

In accordance with some embodiments described herein, a method of preparing the tobacco product as defined herein is provided, the method comprising the steps of:

(a) preparing a tobacco extract in accordance with a method as defined herein; and (b) combining the tobacco extract directly with a tobacco product and/or combining the tobacco extract with reconstituted tobacco and optionally combining the reconstituted tobacco with a tobacco product.

In accordance with some embodiments described herein, the use of the tobacco extract defined herein for improving the sensory properties of a tobacco product is provided.

BRIEF DESCRIPTION OF THE FIGURES

Embodiments of the present invention are described, by way of example only, with reference to the accompanying drawings in which.

DETAILED DESCRIPTION

Method

Figure 1:
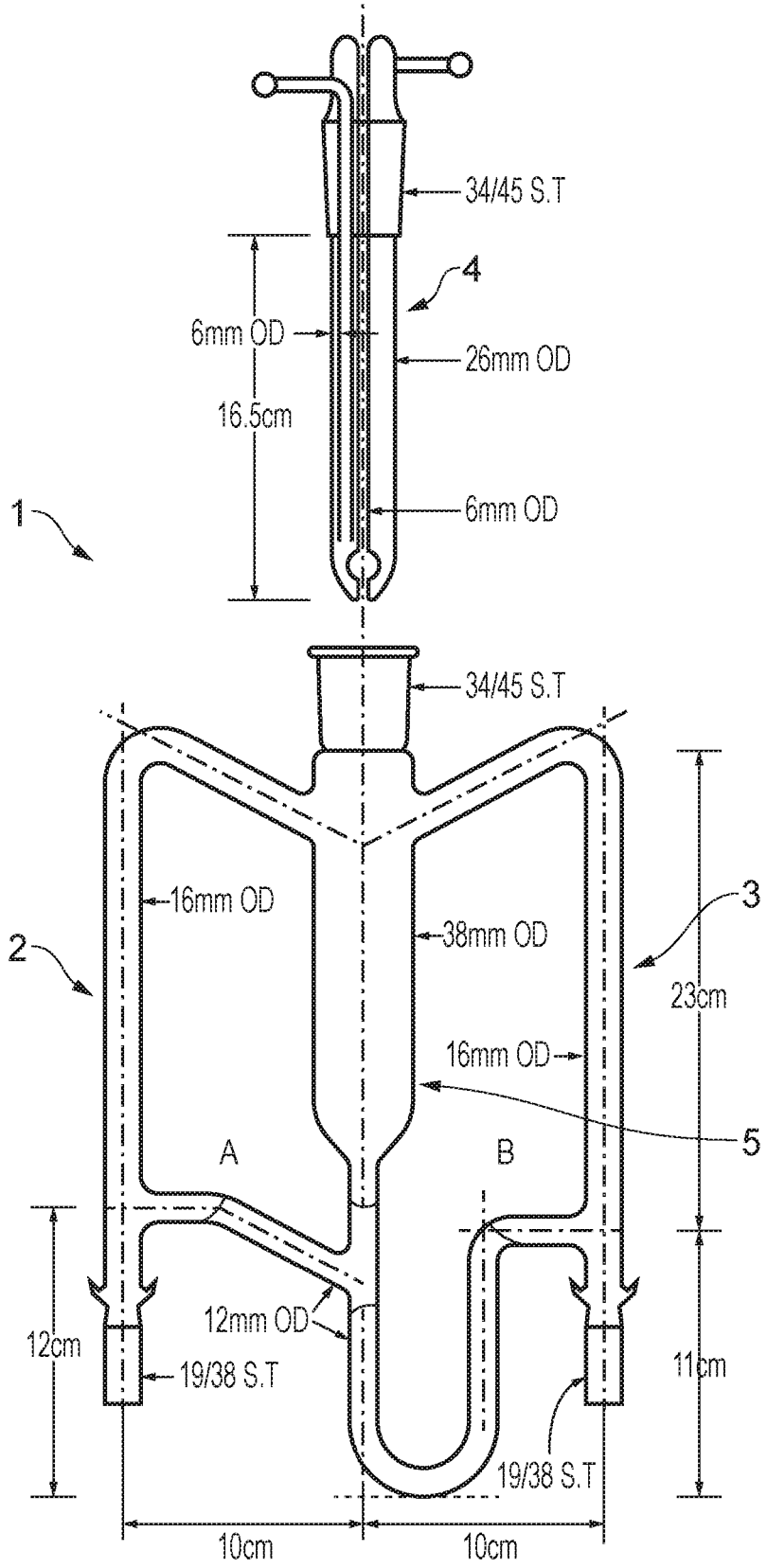
FIG. 1 shows a Likens-Nickerson apparatus for simultaneous distillation-extraction.

A first aspect of the invention provides a method of extracting one or more volatile compounds of interest from tobacco material, the method comprising the steps of:

i) providing tobacco material;

ii) subjecting the tobacco material to steam distillation; and iii) extracting one or more volatile compounds of interest from the tobacco material with a solvent;

wherein distillation step (ii) and extraction step (iii) are carried out simultaneously and at a pH of no greater than 2, and wherein the period during which both the distillation step (ii) and the extraction step (iii) are carried out is from about 8 to about 20 hours.

As used herein, the term "tobacco material" refers to a material derived from a plant of the *Nicotiana* species. The selection of the plant of the *Nicotiana* species is not limited, and the types of tobacco or tobaccos used may vary.

In some embodiments, the tobacco material is selected from flue-cured or Virginia, Burley, sun-cured, Maryland, dark, dark-fired, dark air cured, light air cured, Indian air cured, Red Russian and *Rustica* tobaccos, and mixtures thereof, as well as various other rare or specialty tobaccos, green or cured. Tobacco material produced via any other type of tobacco treatment which could modify the tobacco taste, such as fermented tobacco or genetic modification or crossbreeding techniques, is also within the scope of the present invention. For example, it is envisaged that tobacco plants may be genetically engineered or crossbred to increase or decrease production of components, characteristics or attributes.

In some embodiments, the tobacco material is sun-cured tobacco, selected from Indian Kurnool and Oriental tobaccos, including Katerini, Prelip, Komotini, Xanthi and Yambol tobaccos. In some embodiments, the tobacco material is dark air cured tobacco, selected from Passanda, Cubano, Jatin and Bezuki tobaccos. In some embodiments, the tobacco material is light air cured tobacco, selected from North Wisconsin and Galpao tobaccos.

In some embodiments, the tobacco material is a cured or non-cured mixture of flue-cured, Burley and Oriental tobaccos.

For the preparation of smoking/vaping or smokeless tobacco products, plants of the *Nicotiana* species may be subjected to a curing process. Certain types of tobaccos may be subjected to alternative types of curing processes, such as fire curing or sun curing. Preferably, but not necessarily, harvested tobaccos that are cured are aged.

The tobacco can be harvested in different stages of growth, for example when the plant is about to sprout, produce leaves or even when it starts flowering.

In some embodiments, at least one portion of the plant of the *Nicotiana* species (e.g., at least a portion of the tobacco material) is employed in an immature form. That is, in some embodiments, the plant, or at least one portion of that plant, is harvested before reaching a stage normally regarded as ripe or mature.

In some embodiments, at least a portion of the plant of the *Nicotiana* species (e.g., at least a portion of the tobacco material) is employed in a mature form. That is, in some embodiments, the plant, or at least one portion of that plant, is harvested when that plant (or plant portion) reaches a point that is traditionally viewed as being ripe, over-ripe or mature, which can be accomplished through the use of tobacco harvesting techniques conventionally employed by farmers. Both Oriental tobacco and Burley tobacco plants can be harvested. Also, the Virginia tobacco leaves can be harvested or primed by stalk position.

The *Nicotiana* species may be selected for the content of various compounds that are present in the plant. For example, plants may be selected on the basis that those plants produce relatively high quantities of one or more of the compounds desired to be isolated (i.e. the volatile compounds of interest). In certain embodiments, plants of the *Nicotiana* species are specifically cultivated for their abundance of leaf surface compounds. Tobacco plants may be grown in green-houses, growth chambers, or outdoors in fields, or grown hydroponically.

Various parts or portions of the plant of the *Nicotiana* species may be employed in the method defined herein. In some embodiments, the whole plant, or substantially the whole plant, is harvested and employed as such. As used herein, the term "substantially the whole plant" means that at least 90% of the plant is harvested, such as at least 95% of the plant, such as at least 99% of the plant. Alternatively, in some embodiments, various parts or pieces of the plant are harvested or separated for further use after harvest. In some embodiments, the tobacco material is selected from the leaves, stems, stalks of the plant, and various combinations of these parts. The tobacco material of the invention may thus comprise an entire plant or any portion of a plant of the *Nicotiana* species.

In some embodiments, the tobacco material comprises tobacco leaf. In some embodiments, the tobacco material comprises tobacco leaf that is whole or cut tobacco leaf. In some embodiments, the tobacco material comprises whole tobacco leaf. In some embodiments, the tobacco leaf comprises cut tobacco leaf. In some embodiments, the tobacco material is milled tobacco.

In some embodiments, the tobacco material is stored at temperatures below 0° C. before distillation and extraction. Therefore, in some embodiments, the tobacco material is kept frozen before distillation step (ii) and extraction step (iii) are carried out. In some embodiments, the tobacco material is kept frozen, and is then defrosted until it reaches approximately room temperature (around 22° C.) before distillation step (ii) and extraction step (iii) are carried out.

In some preferred embodiments, the tobacco material does not undergo any heat treatment before distillation step (ii) and extraction step (iii) are carried out. For example, in some embodiments, the tobacco material is not heated to a temperature of greater than about room temperature before distillation step (ii) and extraction step (iii) are carried out. It has been found that, when the tobacco material is not subjected to any heat treatment prior to distillation step (ii) and extraction step (iii) being carried out, the loss of volatile compounds important for the extract flavour and taste prior to the carrying out of said steps (ii) and (iii) may be reduced.

The carrying out of the distillation step (ii) and extraction step (iii) simultaneously is a process known generally in the art as simultaneous distillation-extraction (SDE). SDE provides a technique in which the steps of isolation and extraction of certain compounds from a sample can be achieved simultaneously.

It is generally accepted that the SDE method was created in 1964 by Likens and Nickerson who designed an original device for the analysis of hop oil (Likens S T, Nickerson G B, *ASBC Proc.,* 1964, 5; A. Chaintreau, *Flavour and Fragrance Journal,* 2001, 16: 136-148). In this method, the processes of steam distillation and extraction of volatiles from a sample into a small quantity of solvent are combined. In the original Likens-Nickerson method, a device 1 as shown in FIG. 1 was used to analyse hop oil. The sample (an aqueous solution or a slurry of a solid material in water) was boiled under stirring in the flask connected to the left arm 2. Volatiles were then steam-distilled through the upper part of the left arm 2 and, simultaneously, solvent vapours distilled through the upper part of the right arm 3. Vapours condensed on the cold finger 4, and the extraction process began between both liquid films on the condenser surface 5.

SDE has been found to have utility in the isolation of volatile substances from natural products. In this technique, the material from which the volatile compounds should be removed is subjected to steam distillation and, simultaneously, the compounds distilled are extracted with a solvent.

Figure 2:
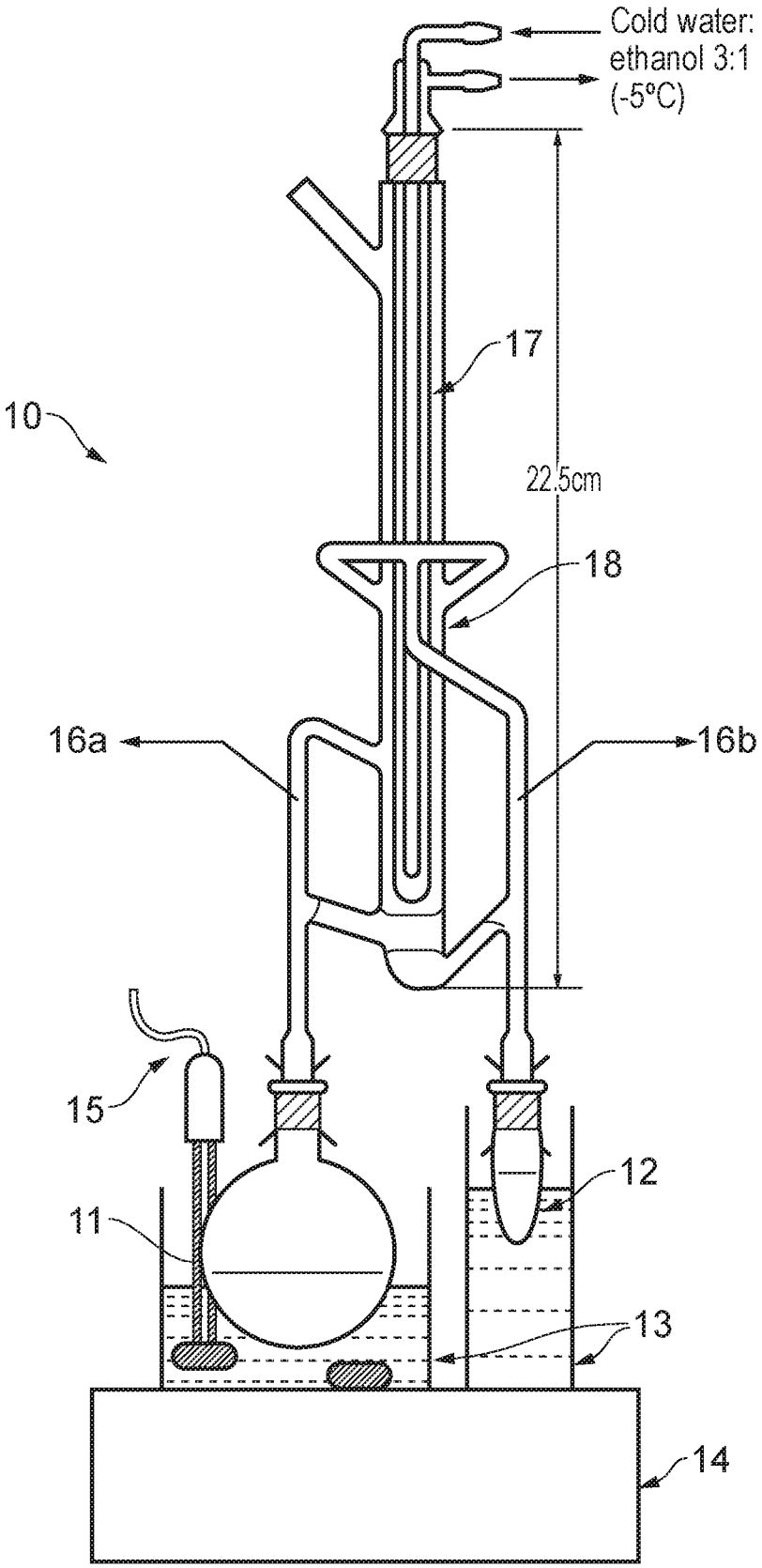
FIG. 2 shows a simultaneous distillation-extraction apparatus, which is useful when the solvent is more dense than water.

A typical apparatus used for SDE is shown in FIG. 2, noting that this apparatus shown is useful for the SDE method where the solvent used is more dense than water. As shown in FIG. 2, the apparatus 10 includes a flask 11 for the tobacco sample, a flask 12 for the solvent, water baths 13 and a heating/stirring plate 14 for heating the samples. The apparatus 10 may typically also include an auxiliary heating coil 15 for heating the tobacco sample to a higher temperature than the solvent such that steam distillation may be carried out. Each of tubes 16*a*, 16*b* have an internal diameter of about 4 mm. During the process, vapours condense on the cold finger 17, and the extraction process may begin between both liquid films on the condenser surface 18. The apparatus used allows the return of the water and solvent distilled to their respective flasks, after the partitioning process. This makes it possible to obtain, by the end of the process, an extract that is ready to be analysed by techniques such as gas chromatography.

In some embodiments, the distillation step (ii) and extraction step (iii) (i.e. SDE) are carried out at a pH of no greater than 2 for the total period of time for which said steps are carried out. It was surprisingly found by the present inventors that, when a pH of no greater than 2 is used during the SDE process, the amount of volatile compounds extracted from the tobacco material is increased.

In some embodiments, the solvent is a non-polar solvent. In some embodiments, the solvent is a polar solvent. As used herein, the term "polar solvent" refers to any solvent having a dielectric constant of greater than or equal to 15. As used herein, the term "non-polar solvent" refers to any solvent having a dielectric constant of less than 15.

In some embodiments, the solvent is immiscible with water.

In some embodiments, the solvent comprises an organic-based solvent. In some embodiments, the solvent is an organic solvent. In some embodiments, the solvent is a non-polar organic solvent. The term "organic" is understood by those skilled in the art. Typically, an organic solvent is considered to be a solvent comprising carbon.

In some embodiments, the solvent is a non-polar solvent that is immiscible with water.

In some embodiments, the solvent is selected from the group consisting of n-butanol, cyclohexane, dichloromethane, ethyl acetate, heptane, hexane, methyl-t-butyl ether, 2-butanone, pentane, diisopropyl ether, diethyl ether, and mixtures thereof. In some embodiments, the solvent is selected from the group consisting of pentane, diethyl ether and mixtures thereof. In some preferred embodiments, the solvent is a mixture of pentane and diethyl ether. The use of a mixture of pentane and ether is preferable as this solvent is non-toxic, and may be easily replaced by ethanol after extraction of the volatile compounds of interest has been achieved.

In some embodiments, the solvent is a mixture of pentane and diethyl ether, wherein the solvent comprises the pentane and diethyl ether in a weight ratio of pentane to diethyl ether of from about 10:1 to about 1:10, such as from about 5:1 to about 1:5, such as from about 3:1 to about 1:3, such as from 3:1 to 1:1, such as from about 3:1 to about 2:1, such as about 2:1. In some embodiments, the solvent is a mixture of pentane and diethyl ether, wherein the solvent comprises the pentane and diethyl ether in a weight ratio of pentane to diethyl ether of from about 3:1 to about 1:1. In some embodiments, the solvent is a mixture of pentane and diethyl ether, wherein the solvent comprises the pentane and diethyl ether in a weight ratio of pentane to diethyl ether of about 2:1.

In some embodiments, the distillation step (ii) and extraction step (iii) (i.e. SDE) are carried out at a pH of no greater than about 2. In some embodiments, the distillation step (ii) and extraction step (iii) (i.e. SDE) are carried out at a pH of from 0.5 to 2. In some embodiments, the distillation step (ii) and extraction step (iii) (i.e. SDE) are carried out at a pH of from 1 to 2. In some embodiments, the distillation step (ii) and extraction step (iii) (i.e. SDE) are carried out at a pH of about 1.6.

It was surprisingly found by the present inventors that, when a pH of no greater than 2 is used, the amount of volatile compounds extracted from the tobacco material is increased. This has the advantage that, when incorporated into tobacco products (such as smoking/vaping articles and/or smokeless tobacco products), the flavour obtained from the extract is more pronounced and, although it is still possible to identify the flavour of tobacco, a series of other desirable notes can also be perceived as a larger number of different compounds are extracted. It has also been surprisingly found by the present inventors that, when the extraction method takes place at pH values of greater than 2, towards the end of the extraction process, the pH values tend to increase thus decreasing the efficiency of the hydrolysis process. When a pH of about 1.6 is used, even if there is an increase in pH during the SDE process, the end pH value is no greater than 2, thus improving the efficiency of the process for any type of tobacco.

In some embodiments, the pH of no greater than 2 is obtained by mixing the tobacco material with an acid. In some embodiments, the acid may be selected from hydrochloric acid, sulfuric acid, and mixtures thereof. In some embodiments, the acid is hydrochloric acid. Treatment with hydrochloric acid (HCl) is the most common hydrolysis method. This is due to the convenience of application of this reagent, as it can be used in both the liquid and gas-phase modes. Also, hydrochloric acid finds many applications in the food industry as it is permitted as a food acidulent by the Food and Agriculture Organisation of the United Nations (FAO).

In some embodiments, the tobacco material is mixed with the acid (e.g. HCl) at an elevated temperature (such as from about 50° C. to about 80° C.) for no more than about 1 hour before distillation step (ii) and extraction step (iii) (i.e. SDE) are carried out. In some embodiments, the tobacco material is mixed with the acid (e.g. HCl) at an elevated temperature (such as from about 50° C. to about 70° C.) for no more than about 45 minutes before distillation step (ii) and extraction step (iii) (i.e. SDE) are carried out. In some embodiments, the tobacco material is mixed with the acid (e.g. HCl) at an elevated temperature (such as approximately 60° C.) for no more than about 30 minutes before distillation step (ii) and extraction step (iii) (i.e. SDE) are carried out. In some embodiments, the tobacco material is mixed with the acid (e.g. HCl) at a temperature of approximately 60° C. for about 20 minutes before distillation step (ii) and extraction step (iii) (i.e. SDE) are carried out.

In some embodiments, the period during which both the distillation step (ii) and the extraction step (iii) (i.e. SDE) are carried out is from about 8 to about 15 hours. In some embodiments, the period during which both the distillation step (ii) and the extraction step (iii) (i.e. SDE) are carried out is from about 8 to about 10 hours. In some embodiments, the period during which both the distillation step (ii) and the extraction step (iii) (i.e. SDE) are carried out is about 9 hours. In some embodiments, the period during which both the distillation step (ii) and the extraction step (iii) (i.e. SDE) are carried out is about 8 hours.

As the skilled person will appreciate, the typical time for SDE to be carried out is around 5 hours. It was surprisingly found by the present inventors that, when the SDE is carried for a period of at least 8 hours (and preferably comprising only a single step in the SDE process for this period of at least 8 hours), the concentration of the volatile compounds in the resulting extract (or distillate) was increased significantly. This has the advantage that, when incorporated into tobacco products (such as smoking/vaping articles and/or smokeless tobacco products), the sensory characteristics of the tobacco products are improved and the flavour obtained from the extract is more pronounced.

In some embodiments, the distillation step (ii) and the extraction step (iii) (i.e. SDE) are carried out at a temperature of up to about 130° C.

In some embodiments, the distillation step (ii) is carried out at a temperature of from about 100° C. to about 130° C., such as from about 105° C. to about 125° C., such as from about 110° C. to about 125° C., such as from about 115° C. to about 125° C., such as from about 120° C. to about 122° C., such as approximately 121° C.

In some embodiments, the extraction step (iii) is carried out at a temperature of from about 50° C. to about 100° C., such as from about 60° C. to about 95° C., such as from about 70° C. to about 90° C., such as from about 75° C. to about 90° C., such as from about 80° C. to about 90° C., such as from about 85° C. to about 90° C.

In some embodiments, the distillation step (ii) and the extraction step (iii) (i.e. SDE) are carried out at atmospheric pressure.

In some embodiments, the distillation step (ii) and extraction step (iii) are carried out simultaneously in one single step. As such, in some embodiments, the SDE method described herein is carried out in just one single step. In some embodiments, an additional distillation and/or extraction step is excluded. In some embodiments, the entire SDE method (i.e. distillation step (ii) and extraction step (iii)) is carried out simultaneously in one single piece of apparatus with no additional processing prior to removal of the extracted product from the apparatus.

In some embodiments, the one or more volatile compounds of interest extracted from the tobacco material are selected from the group consisting of: sugars, sugar esters, amino acids, beta-carotene, violaxanthin, lutein, neoxanthin, phytol, labdanoids, cembranoids, polyphenols, lignin, and mixtures thereof.

In some embodiments, the one or more volatile compounds of interest extracted from the tobacco material are selected from the group consisting of: methyl butanol, benzyl alcohol, phenylethanol, methoxyvinylphenol, vinylphenol, hydroxydamascone, furfural, hydroxymethylfurfural, furaneol, cyclotene, dimethylpyrazines, trimethylpyrazine, tetramethylpyrazine, hydroxymethyl(methyl) pyrazines, isophorone, ketoisophorone, safranal, iononas, damascenone, beta-damascenone, megastigmatrienone, beta-damascone, beta-ionone, 2,6-nonadienal, 2-nonenal, linalool, linalool oxide, geranyl acetone, farnesyl acetone, methylheptadienone, solanone, solanascone, norambrenolide, ambroxide, sclareolide, isobutyric acid, isovaleric acid, 3-methylvaleric acid, heptanoic acid, benzoic acid, phenylacetic acid, ortho, para-cresol, methional, guaiacol, vinylphenol, ethylguaicol, vinylguaiacol, eugenol, vanillin and mixtures thereof.

In some embodiments, the one or more volatile compounds of interest extracted from the tobacco material are responsible for a characteristic taste or flavour of at least one tobacco variety.

In some embodiments, the extract obtained from the tobacco material is substantially free of alkaloids and/or tobacco-specific nitrosamines (TSNAs). In some embodiments, the extract obtained from the tobacco material is substantially free of nicotine and/or TSNAs.

As used herein "substantially free of alkaloids" means that the extract comprises less than about 15% by weight of alkaloids (such as nicotine), such as less than about 10% by weight of alkaloids (such as nicotine), such as less than about 5% by weight of alkaloids (such as nicotine), such as less than about 2% by weight of alkaloids (such as nicotine), such as less than about 1% by weight of alkaloids (such as nicotine), such as less than about 0.5% by weight of alkaloids (such as nicotine), such as less than about 0.1% by weight of alkaloids (such as nicotine). In some embodiments, the extract obtained from the tobacco material comprises less than about 1% by weight of alkaloids (such as nicotine).

Without wishing to be bound by theory, the use of a pH of no greater than 2 allows any nicotine present in the tobacco material to react with hydrochloric acid (HCl) to form a water-soluble salt, nicotine hydrochloride. This salt is not extracted during the method of the present invention.

As used herein "substantially free of TSNAs" means that the extract comprises less than about 15% by weight of TSNAs, such as less than about 10% by weight of TSNAs, such as less than about 5% by weight of TSNAs, such as less than about 2% by weight of TSNAs, such as less than about 1% by weight of TSNAs, such as less than about 0.5% by weight of TSNAs, such as less than about 0.1% by weight of TSNAs. In some embodiments, the extract obtained from the tobacco material comprises less than about 1% by weight of TSNAs.

In some embodiments, further processing of the extracted product may be carried out after the distillation step (ii) and the extraction step (iii) (i.e. SDE) have been carried out. It is noted that this further processing is not considered to be an additional step in the SDE method itself, but rather an additional processing step on the distillate obtained from the SDE method.

The method of further processing may be carried out in several ways. The method of further processing may depend on the compounds present in the extract and/or the type of solvent used in the extraction. For example, in some embodiments, when an organic non-polar solvent (e.g., pentane, diethyl ether or a mixture thereof) is used to extract one or more compounds from the steam distilled tobacco material, the solvent, after being in contact with the distilled material, may simply be filtered or dried to remove particulate tobacco material and the solvent, and the filtrate may be concentrated.

In some embodiments, further processing of the extracted product is carried out, the further processing comprising a purifying step which comprises replacing the solvent used for extraction with another solvent suitable for use in a tobacco product. In some embodiments, such a purifying step comprises replacing the solvent used for extraction (e.g., pentane, diethyl ether or a mixture thereof, preferably a 2:1 mixture of pentane:diethyl ether) with ethanol. The replacement of the solvent with ethanol is desirable for use in tobacco products.

In some embodiments, further processing of the extracted product is carried out, the further processing comprising subjecting an isolated compound or mixtures of these compounds to conditions that lead this/those compound/s to suffer chemical transformation. For example, the tobacco material obtained from plants of the *Nicotiana* species or a portion of these plants and also the extracts containing the isolated compound(s) may be treated to cause chemical transformation and/or be admixed with other ingredients. The chemical transformations or modification of the tobacco material, extract, or isolated compound(s) can result in changes of certain chemical and physical properties of the tobacco material, extract, or isolated compound(s) (e.g., the sensory attributes thereof). Exemplary chemical modification processes include acid/base reaction, hydrolysis, oxidation, heating and/or enzymatic treatments. As a result of these processes, compounds can undergo various degradation reactions.

In some embodiments, the one or more volatile compounds of interest extracted from the tobacco material are degradation products selected from the group consisting of: sugars, sugar esters, amino acids, beta-carotene, violaxanthin, lutein, neoxanthin, phytol, labdanoids, cembranoids, polyphenols and lignin, and mixtures thereof. In some embodiments, such degradation products may be further treated to provide various flavour compounds, selected from the group consisting of methylbutanol, benzyl alcohol, phenylethanol, methoxyvinylphenol, vinylphenol, hydroxydamascone, furfural, hydroxymethylfurfural, furaneol, cyclotene, dimethylpyrazines, trimethylpyrazine, tetramethylpyrazine, hydroxymethyl(methyl)pyrazines, isophorone, ketoisophorone, safranal, iononas, beta-damascenone, megastigmatrienone, beta-damascone, beta-ionone, 2,6-nonadienal, 2-nonenal, linalool, linalool oxide, geranyl acetone, farnesyl acetone, methylheptadienone, solanone, solanascone, norambrenolide, ambroxide, sclareolide, isobutyric acid, isovaleric acid, 3-methylvaleric acid, heptanoic acid, benzoic acid, phenylacetic acid, orthocresol, para-cresol, methional, guaiacol, vinylphenol, ethylguaicol, vinylguaiacol, eugenol, and vanillin.

As used herein, "degradation products" are any compounds that are produced from the compounds extracted and/or degraded according to the present invention. Degradation products can be formed naturally from such compounds or may be produced by an accelerated degradation process (e.g., by the addition of heat and/or chemicals to accelerate the breakdown of the compounds). These compounds can be degraded, for example, by means of oxidation and/or hydrolysis reactions (e.g., through treatment with hydrochloric acid or other acid agent).

In some embodiments, residual tobacco material is present in the waste material resulting from the extraction method described herein. In some embodiments, the waste material resulting from the extraction method as described herein may be used as a raw material for reconstituted tobacco or briquette production.

Tobacco Extract

A second aspect of the invention provides a tobacco extract obtainable or obtained by the method as described above, wherein the tobacco extract comprises one or more volatile compounds of interest in an amount of at least about 75% by weight of the tobacco extract.

In some embodiments, the tobacco extract is obtainable or obtained by the method comprising the steps of:

i) providing tobacco material;

ii) subjecting the tobacco material to steam distillation; and iii) extracting one or more volatile compounds of interest from the tobacco material with a solvent;

wherein distillation step (ii) and extraction step (iii) are carried out simultaneously and at a pH of no greater than 2, and wherein the period during which both the distillation step (ii) and the extraction step (iii) are carried out is from about 8 to about 20 hours; wherein the tobacco extract comprises one or more volatile compounds of interest in an amount of at least about 75% by weight of the tobacco extract.

In some embodiments, the tobacco extract is obtainable or obtained by a method as defined in any one of the embodiments described above.

In some embodiments, the tobacco extract comprises the one or more volatile compounds of interest in an amount of at least about 80% by weight of the tobacco extract, such as in an amount of at least about 85% by weight of the tobacco extract, such as in an amount of at least about 90% by weight of the tobacco extract, such as in an amount of at least about 95% by weight of the tobacco extract, such as in an amount of at least about 97% by weight of the tobacco extract.

In some embodiments, the tobacco extract comprises the one or more volatile compounds of interest in an amount of at least about 95% by weight of the tobacco extract.

In some embodiments, the one or more volatile compounds of interest in the tobacco extract are selected from the group consisting of: sugars, sugar esters, amino acids, beta-carotene, violaxanthin, lutein, neoxanthin, phytol, labdanoids, cembranoids, polyphenols, lignin, and mixtures thereof.

In some embodiments, the one or more volatile compounds of interest in the tobacco extract are selected from the group consisting of: methyl butanol, benzyl alcohol, phenylethanol, methoxyvinylphenol, vinylphenol, hydroxydamascone, furfural, hydroxymethylfurfural, furaneol, cyclotene, dimethylpyrazines, trimethylpyrazine, tetramethylpyrazine, hydroxymethyl(methyl)pyrazines, isophorone, ketoisophorone, safranal, iononas, damascenone, beta-damascenone, megastigmatrienone, beta-damascone, beta-ionone, 2,6-nonadienal, 2-nonenal, linalool, linalool oxide, geranyl acetone, farnesyl acetone, methylheptadienone, solanone, solanascone, norambrenolide, ambroxide, sclareolide, isobutyric acid, isovaleric acid, 3-methylvaleric acid, heptanoic acid, benzoic acid, phenylacetic acid, ortho, para-cresol, methional, guaiacol, vinylphenol, ethylguaicol, vinylguaiacol, eugenol, vanillin and mixtures thereof.

In some embodiments, the tobacco extract is substantially free of alkaloids and/or tobacco-specific nitrosamines (TSNAs). In some embodiments, the tobacco extract is substantially free of nicotine and/or TNSAs.

As used herein "substantially free of alkaloids" means that the tobacco extract comprises less than about 15% by weight of alkaloids (such as nicotine), such as less than about 10% by weight of alkaloids (such as nicotine), such as less than about 5% by weight of alkaloids (such as nicotine), such as less than about 2% by weight of alkaloids (such as nicotine), such as less than about 1% by weight of alkaloids (such as nicotine), such as less than about 0.5% by weight of alkaloids (such as nicotine), such as less than about 0.1% by weight of alkaloids (such as nicotine). In some embodiments, the tobacco extract comprises less than about 1% by weight of alkaloids (such as nicotine).

As used herein "substantially free of TSNAs" means that the tobacco extract comprises less than about 15% by weight of TSNAs, such as less than about 10% by weight of TSNAs, such as less than about 5% by weight of TSNAs, such as less than about 2% by weight of TSNAs, such as less than about 1% by weight of TSNAs, such as less than about 0.5% by weight of TSNAs, such as less than about 0.1% by weight of TSNAs. In some embodiments, the tobacco extract comprises less than about 1% by weight of TSNAs.

Tobacco Product

A third aspect of the invention provides a tobacco product comprising a tobacco extract as defined above.

In some embodiments, the tobacco product is a smoking/vaping article or a smokeless tobacco product, an electronic device, a heating device, or a hybrid of both, a cigarette, a cigar, or a smokeless oral tobacco product.

In some embodiments, the tobacco product is a smoking/vaping article or a smokeless tobacco product. In some embodiments, the tobacco product is a cigarette, a cigar, or a smokeless oral tobacco product.

The tobacco extract may be employed as a component of a tobacco product in a variety of ways. The tobacco extract may be employed as a component of processed tobaccos. In some embodiments, the tobacco extract may be employed within a flavour or casing formulation for application to a tobacco strip or within a top dressing formulation. Alternatively, the tobacco extract may be employed as an ingredient of a reconstituted tobacco material. The tobacco extract may be incorporated into a cigarette filter (e.g., in the filter plug, plug wrap, or tipping paper) or incorporated into cigarette wrapping paper, preferably on the inside surface, during the cigarette manufacturing process.

In some embodiments, the tobacco extract is included in the tobacco product in the form of a flavourant, a casing or a combination thereof, or in the form of reconstituted tobacco which includes the tobacco extract.

In some embodiments, the tobacco product is an electronic device, a heating device, or a hybrid of both. In such embodiments, the application of the tobacco extract may be adapted to the respective characteristics of those technologies. For example, in some embodiments, the tobacco product is an electronic device (e.g. an electronic cigarette) comprising the tobacco extract in the inhalable liquid contained therein. In some embodiments, the tobacco product is a heating device comprising the tobacco extract in the tobacco, filter or consumable paper included therein.

The amount of tobacco product may comprise the tobacco extract in any suitable amount depending on the desired function of the tobacco extract, the chemical composition of the extract and the type of tobacco product to which the extract is added. In some embodiments, the tobacco product comprises the tobacco extract in an amount of from about 0.0001% to about 15% of the tobacco product based on the total dry weight of the tobacco product to which the extract is added. In some embodiments, the tobacco product comprises the tobacco extract in an amount of from about 0.01% to about 10% by weight of the tobacco product based on the total dry weight of the tobacco product to which the extract is added. In some embodiments, the tobacco product comprises the tobacco extract in an amount of from about 0.1% to about 5% by weight of the tobacco product based on the total dry weight of the tobacco product to which the extract is added.

Method of Preparing Tobacco Product

A fourth aspect of the invention provides a method of preparing the tobacco product described herein, the method comprising the steps of:

(a) preparing a tobacco extract in accordance with a method as described herein; and
(b) combining the tobacco extract directly with a tobacco product and/or combining the tobacco extract with reconstituted tobacco and optionally combining the reconstituted tobacco with a tobacco product.

In some embodiments the method of preparing the tobacco product comprises the steps of:

(a) preparing a tobacco extract in accordance with a method as described herein; and
(b) combining the tobacco extract directly with a tobacco product.

In some embodiments, the tobacco extract is combined directly with a tobacco product by adding the tobacco extract to the tobacco product in its liquid form, by adding the tobacco extract to the tobacco product in the form of a casing, or by a combination thereof.

In some embodiments the method of preparing the tobacco product comprises the steps of:

(a) preparing a tobacco extract in accordance with a method as described herein; and
(b) combining the tobacco extract with reconstituted tobacco, and combining the reconstituted tobacco with a tobacco product.

Use

A fifth aspect of the invention provides the use of the tobacco extract as described herein for improving the sensory properties of a tobacco product.

In some embodiments, there is provided the use of a tobacco extract obtained or obtainable from the method described herein for improving the sensory properties of a tobacco product.

In some embodiments, the tobacco extract described herein is used for enhancing the flavour of a tobacco product.

EXAMPLES

Example 1

Figure 3:
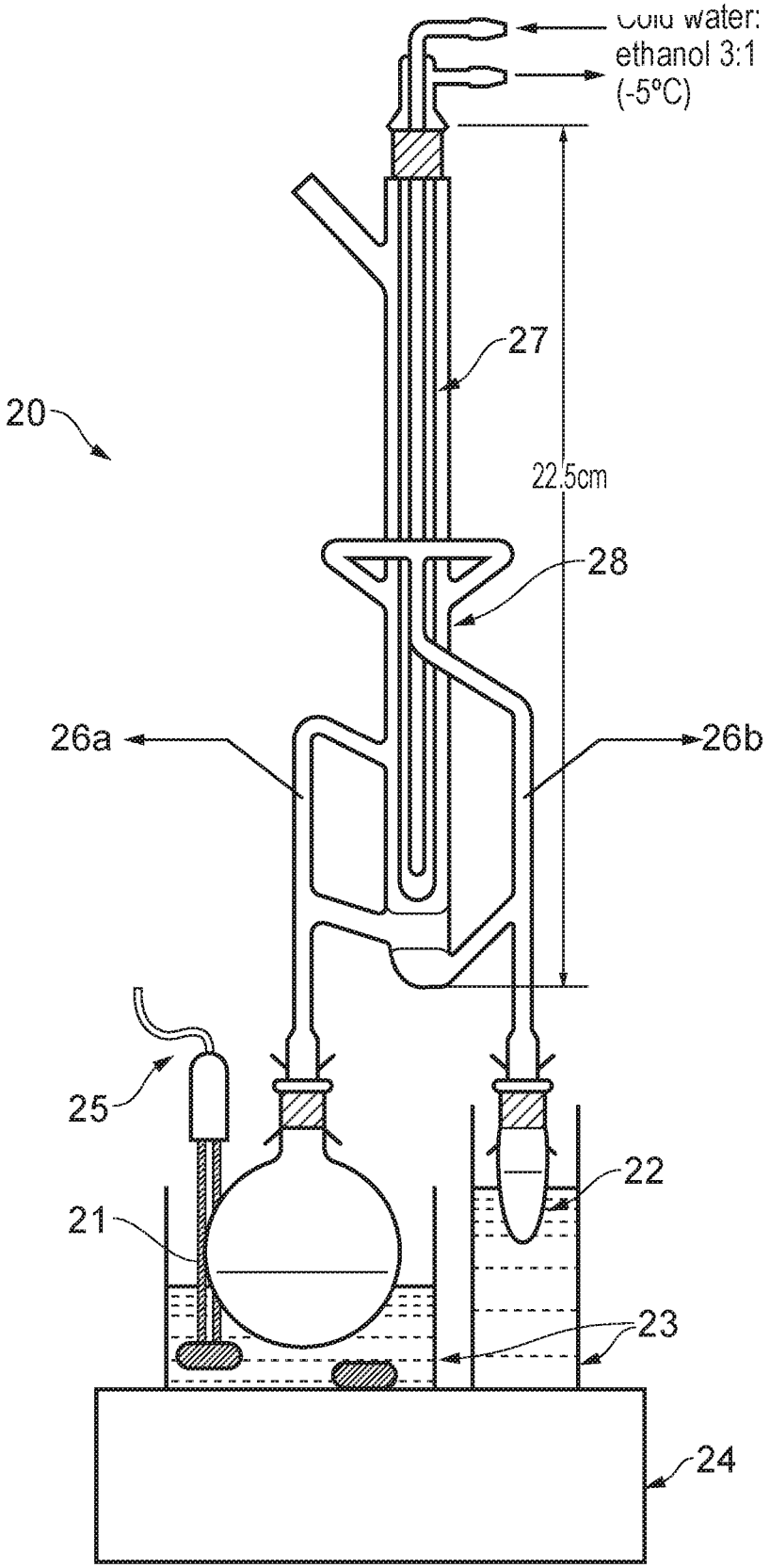
FIG. 3 shows a simultaneous distillation-extraction apparatus used in Example 1, which is useful when the solvent is less dense than water.

The method according to the invention was carried out using the apparatus shown in FIG. 3. The apparatus shown in FIG. 3 is useful where the solvent used is less dense than water (such as pentane:diethyl ether (2:1)). As shown in FIG. 3, the apparatus 20 includes a 100 mL flask 21 for the tobacco sample, a 2 mL flask 22 for the solvent, water baths 23 and a heating/stirring plate 24 for heating the samples. The apparatus 20 also includes an auxiliary heating coil 25 for heating the tobacco sample to a higher temperature than the solvent such that steam distillation may be carried out. During the process, vapours condensed on the cold finger 27, and the extraction process began between both liquid films on the condenser surface 28. Each of tubes 26*a*, 26*b* have an internal diameter of about 4 mm.

To the 2 mL flask 22 of the apparatus shown in FIG. 3, 1 mL of pentane:diethyl ether (2:1) mixture and fragments of pumice stone were added. In the 100 mL flask 21, 5 g of tobacco (dry bases weight; various grades of Burley and Virginia tobacco were used as the tobacco material, some considered of high and others of low quality), fragments of pumice stone, bi-distilled water and about 1 mL of hydrochloric acid (HCl 37%) were added such that the pH desired for the aqueous solution in contact with the tobacco was attained and the volume of this solution remained equal to 40 mL. Preliminary tests showed that the tobacco should be left in contact with the acid for 20 minutes, at about 60° C., to assure that the pH desired will be maintained in the SDE system after mixing the acid solution with the tobacco.

The two flasks 21 and 22 were then connected to the body of the apparatus and the bi-distilled water and the pentane: diethyl ether (2:1) were mixed until the two liquids started returning to their respective flasks.

The flasks 21 and 22 were placed in baths previously heated up to 100 and 140° C., respectively, such that the levels in the flasks remained slightly above the levels of the baths. When the liquids in the flasks began to boil, it was observed whether the temperature in the smaller bath stabilised between 85 and 90° C. and that of the bigger flask between 120 and 122° C. Adjustments were made, where necessary, in order that the SDE process is accomplished in the recommended temperature ranges.

The system was operated for 9 hours and, during this period, it was observed whether the level in the flask containing the extract was constant. A little more of the pentane:diethyl ether (2:1) mixture was added, when necessary, through the system's side-outlet in order to ensure that the level of liquid in the flask containing the extract was kept constant.

After 9 hours, the equipment was lifted out of the water baths and left to cool until the extract temperature equilibrated to room temperature. The extract was transferred to a calibrated tube and the volume adjusted to 1.5 mL with the pentane:diethyl ether (2:1) mixture.

Exchange of Pentane:Diethyl Ether Solution for Ethanol 1.5 mL of absolute ethanol and fragments of pumice stone were added to the tube containing the extract. The solution was concentrated up to approximately 1.5 mL in a bath at 60° C. When the boiling ceased, the tube was kept in contact with the bath for 30 minutes more to ensure that both the pentane and diethyl ether had been removed. The pentane: diethyl ether solvent had thus been replaced by ethanol solvent, and the extract was now in ethanol solution. The extract in ethanol could be injected directly into cigarettes, applied to tobacco before cigarette preparation or applied in electronic, heating or hybrid devices for a subsequent sensorial evaluation.

It was found that the addition of 1 μl of the extract to a cigarette was capable of clearly altering the organoleptic characteristics of the smoke of the tobacco product, and even 0.5 μl was considered to be an acceptable level of addition.

Considering that this level of addition corresponds to the application of the extract obtained from 6 kg of tobacco over 3 tons of the tobacco to be used for cigarette manufacturing, it can be concluded that the extracts are highly potent. The same can be said regarding their stability, since the extract was found to be able to be stored for six months without having its characteristics altered.

It was also found that extracts obtained by SDE in acid medium presented a great potential as flavours for cigarettes due to the characteristics which they impart to the smoke. Also, a decrease in irritating sensations, an increase in the amplitude and the fact that they enhance the tobacco basic notes, such as green and earthy, without imparting artificial characteristics to the cigarettes was further noted. Moreover, the extracts were found not to present any problems from a toxicological point of view to be used as flavours for cigarettes.

The same approach detailed above was conducted to evaluate the extract taste performance into capsules and tobacco products such as electronic devices, heating devices and hybrid devices, and the potential for use of the extracts in such products was confirmed.

Example 2

Figure 4:
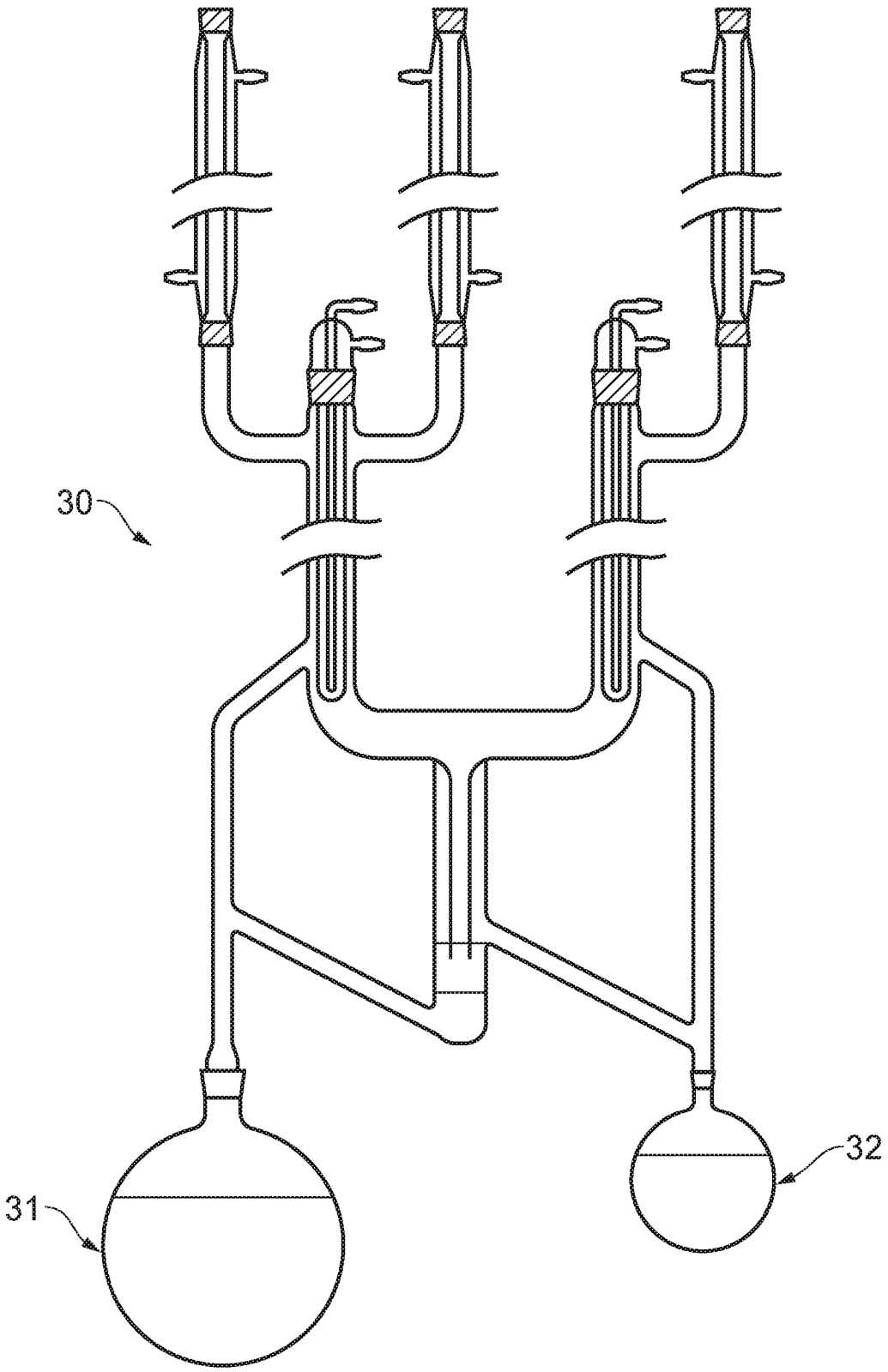
FIG. 4 shows the simultaneous distillation-extraction apparatus used in Example 2, which is useful when the solvent is less dense than water.

An apparatus 30 as shown in FIG. 4 was used in order to extract volatile compounds of interest from a larger sample of tobacco material. In this Example, 2240 g of tobacco, 933 mL of hydrochloric acid 6 N (466.5 mL of HCl 37%+466.5 mL of water), 15 L of water and 100 g of pumice stones (PA), were placed in a 24 L round bottom flask 31 on a heating mantle. The mixture was stirred carefully with the aid of a glass rod in order to obtain a homogeneous mixture. 200 mL of pentane:diethyl ether (2:1) mixture with 5 g of pumice stones was placed in the smaller round bottom flask 32.

The body of the SDE apparatus was connected to the flasks with the aid of claws so that the system became free of tension. After connecting the flasks to the apparatus, some drops of water were placed (with the aid of a pipette) in the joints to assist in the sealing. With the aid of a pipette, water was added to the central part of the apparatus body to raise the level, on the left side arm, to near the return level.

With the aid of a pipette, the pentane:diethyl ether (2:1) mixture was slowly added to the body of the apparatus through the walls until the level rise on the right side arm at the level of return. In case the return levels were not achieved at the same time with the system vertically, the apparatus was tilted slightly as required.

The condensers were connected to the body of the apparatus and the cooling system turned on (commercial ethanol: water—2:1).

Both round bottom flasks were heated. This heating was achieved by connecting the voltage controllers that were connected to the heating mantles where the two flasks were situated on the positions previously determined. These positions enabled the temperatures to be sufficient for the liquids contained in the two flasks to come to the boil without turbulence.

When the solution in the smaller flask began to reflux, the beginning of the 9 h of distillation was started. Throughout this period, the largest flask and the side arms of the apparatus were kept covered with asbestos or aluminium foil.

Until the system reached the equilibrium (the two liquids simultaneously distilling and returning to their flasks), the system required continued attention. If one of the solvent layers (pentane-ether or water) raised more than should, tending to move to the opposite flask, the system had to be tilted slightly to the side of the solvent which was in excess.

In case the volume of pentane-ether decreased during the SDE process, more was added with the aid of a pipette by the top of the condenser, thus restoring the lost amount of solution.

After the period of 9 hours of distillation, the heating was turned off and the system left until boiling had ceased. After the boiling had ceased, the flask containing the pentane-ether was removed and 45 mL of absolute ethanol was added to this mixture. The solution was concentrated in an apparatus for distillation at 45° C. until no further boiling was observed. The temperature was raised to 65° C. for 15 more minutes. After these 15 minutes, the heating was turned off, and the system left to cool until the solution reached room temperature. The solution was then transferred to a beaker and the volume made up to 45 mL with absolute ethanol. This final solution was then ready to be used as flavouring.

Figure 5:
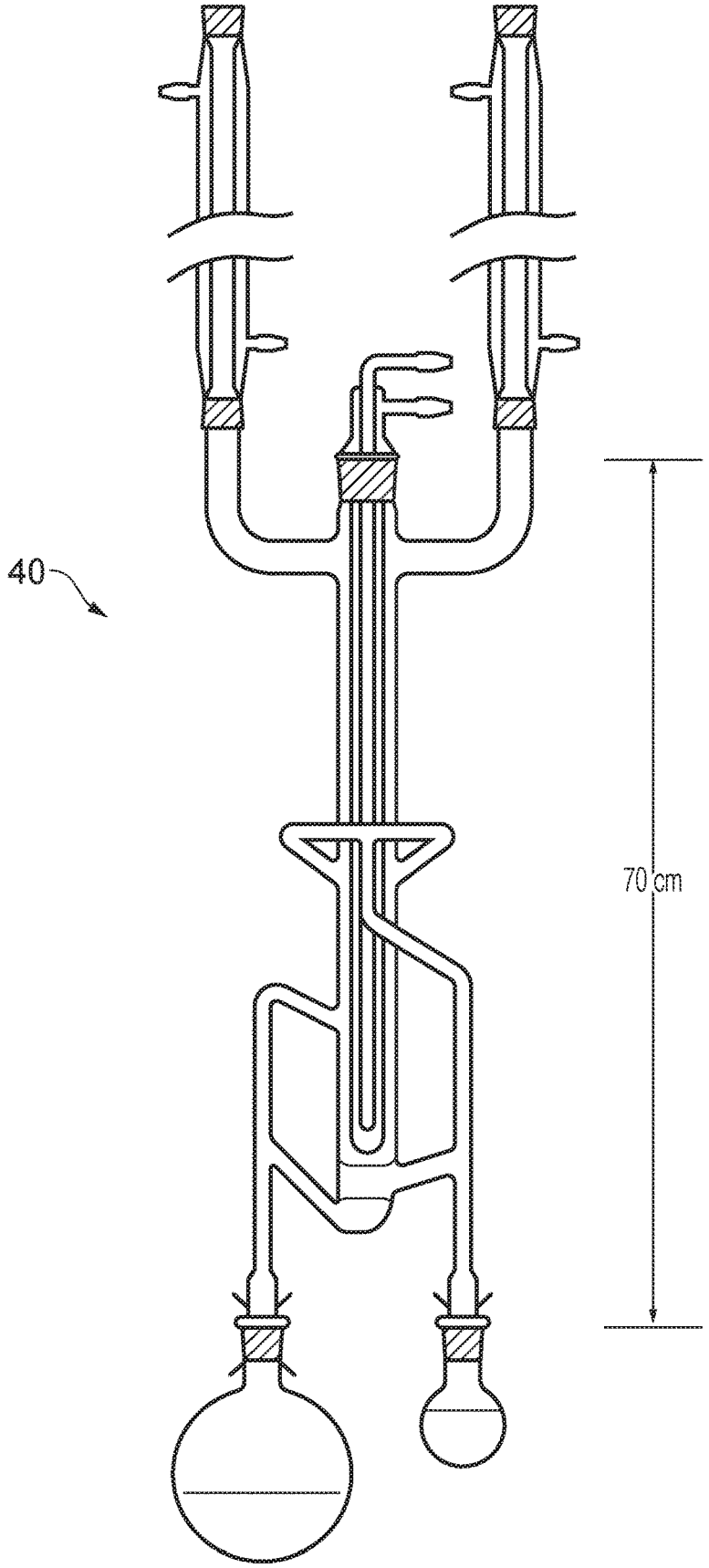
FIG. 5 shows the simultaneous distillation-extraction apparatus of FIG. 3 that has been enlarged in order to extract compounds from a 2240 g sample of tobacco.

It is noted that, the procedure described above was carried out on an apparatus as shown in FIG. 4. It was found that, carrying out the procedure on an apparatus 40 as shown in FIG. 5 (which is merely an enlargement of the apparatus used for 5 g of tobacco in Example 1, and which is shown in FIG. 3), resulted in slight difficulties. It was, for instance, difficult for the distilled pentane and ethyl ether to return to the equipment's body due to the great amount of water that entered the system below them.

Therefore, the apparatus shown in FIG. 4 was designed, wherein the two condensers at the top part of the equipment shown in FIG. 5 were adapted to allow the distillation of the water, at an acceptable rate, without losing the more volatile compounds. The apparatus shown in FIG. 4 was designed to by-pass the above-identified problems when obtaining extracts from 2240 g of tobacco. As shown in FIG. 4, the water containing the compounds distilled and the organic solvents were condensed in independent condensers and only met each other when they were already cold. This made it possible to carry out the heating up of the tobacco with the acid solution in the desired way, without interfering in the return of the distilled ethyl ether and pentane.

Comparative Example 1—Comparison of SDE Method with Neutral Volatile Scan (NVS)

A comparison of the chromatograms of extracts obtained by SDE and NVS was made.

Through the NVS method, it was postulated that the compounds naturally found in tobacco are isolated, and practically all the substances present in the SDE extract should be present in the NVS extract, if the process which led to their isolation were a simple steam distillation.

In order to carry out a comparison between the extracts, several Burley and Virginia tobacco grades were evaluated.

The procedure for tobacco analysis by the NVS method was as follows:

1. To a Soxhlet extractor (500 ml flask, Whatman 33×80 mm cellulose cartridge), 300 ml of dichloromethane and 5.0 g of tobacco were added. The flask was heated in a water bath at 50-55° C. for 6.5 hours. Extraction time could be lengthened to 16 hours, if considered suitable. Throughout the extraction period, the system was maintained in an inert atmosphere and exposing the extract to the light was avoided by covering the lower part of the apparatus with aluminium foil. The extract was transferred into a 500 ml separation funnel and the flask washed with small portions of dichloromethane. More dichloromethane was added to the extract in cases where the volume was less than 300 ml.
   To create an inert atmosphere in the apparatus used for tobacco extraction and in the apparatuses identified below in steps 4 and 6, a flexible tube was used to couple the apparatus exit with a 2.0 cm I.D. glass tube through which nitrogen gas is passed at an approximate flow rate of 100 ml/min. Prior to system warm-up, the glass tube end was closed, and the apparatus joints maintained half-open so as to force nitrogen gas to run through the apparatus. After fifteen minutes, the glass tube end was opened, and the joints properly adjusted. To prevent the solvent not condensed during extractions or distillations from accumulating on the flexible tube (thus running back into the apparatus and then contaminating it), the glass tube was maintained below the point at which it is coupled with the apparatus, a flexible tube with proper internal diameter was used, and the apparatus modified (if need be) so that the exit onto which the flexbile tube is coupled is in a downslope condition.
2. The extract was then partitioned six times with 150 ml of a pH=6.0 buffer solution containing 0.092M $Na_2HPO_4$ and 0.48M $KH_2PO_4$. The solutions were stirred for 15 seconds and rested for 5 minutes prior to discarding the aqueous phase. If the separation of the two phases was not clear at the interface, most of the organic phase was removed from the funnel, 10 ml of dichloromethane added thereto, and stirred again and allowed to rest until the separation between the phases was complete.
3. After partitioning, the organic phase was run through a 2.5×200 mm glass column containing 50 g anhydrous sodium sulfate. Column flow rate was approximately 5 ml/min. The column was washed with dichloromethane.
4. The solution was concentrated in an apparatus as described above in step 1. The flask was heated in a water bath at 55-60° C., and the entire system maintained in an inert atmosphere as described above in step 1, and its lower part prevented from light exposure by covering it with an aluminium foil. The extract volume was reduced to approximately 1 ml. The residue was transferred into a graduated tube and made up to a volume of 4 ml with a 7.5% v/v ethanol solution in dichloromethane.
5. To a 15 cm×15 mm I.D. glass column was added 1.75 g 100-200 mesh Florisil together with a 7.5% v/v solution of ethanol in dichloromethane. The excess solution was removed until its level was just above that of the Florisil, and the extract obtained in step 4 was applied thereto. The resultant mixture was eluted with a solution identical with that used in column preparation, and 40 ml collected therefrom.
6. 40 ml of dichloromethane was added to the solution collected, and the solution was concentrated to a volume of approximately 1 ml, as described above in step 4. 60 μl of ethyl palmitate (internal standard) solution in ethanol was added, homogenised by manual stirring, and the concentrate transferred to a graduated tube. The solution was made up to a volume of 3 ml with dichloromethane.
7. The resulting extract was then analysed by gas chromatography using a Hewlett-Packard chromatograph, model 5880A, under the following conditions:
   Carrier gas: $H_2$, 20 psi; $t_M$ 120° C., 0.70 min; split ratio 15:1.
   Injected volume: 2 μl.
   Injection technique: fill syringe with solvent prior to pulling in the extract and inject with hot-needle technique, as described in Grob, Jr, K. & Neurom, H. P., *J. High Resol. Chromat. Chromat. Comm.*, 15-21, 1979.
   Integrator: Hewlett-Packard 3356B Laboratory Automation System.
   Column: 25 m×0.2 mm I.D., crosslinked methyl silicone; film thickness 0.50 μm, fused silica.
   Oven temperature profile: initial value—120° C.; initial time—0.00 min
   Level 1:

Program rate: 1.50° C./min
Final value: 155° C.
Final time: 0.00 min
Level 2:
Program rate 0.80° C./min
Final value: 210° C.
Final time: 0.00 min
Level 3 (column purge time):
Program rate: 30.00° C./min
Final value: 300° C.
Final time: 35 min
Detector: FID; 300° C.; H2, 30 ml/min; air, 300 ml/min; nitrogen/makeup, 30 ml/min
Injector: 200° C.; mixing chamber type liner
Additional commands (actuated automatically)
90.00 min—signal off (recorder)
90.00 min—injector temperature, 275° C.
115.00 min—injector temperature, 200° C.

The SDE method was carried out using the method described in Example 1, except that a pH of 5.0-6.0 was used, which is not in accordance with the present invention.

Table 1 shows the results obtained in one of these comparisons, which confirms the above conclusions.

TABLE 1 comparison of the relative areas of various peaks of flavour compounds isolated by the NVS and SDE methods from Virginia tobacco

| Compound | NVS (relative area of chromatogram peaks) | SDE (relative area of chromatogram peaks) |
|---|---|---|
| Solanone | 13.4 | 69.4 |
| Damascenone | 1.0 | 3.1 |
| Solanol | 1.3 | 9.8 |
| beta-Damascone | 1.0 | 6.8 |
| Megastigmatrienone* | 86.0 | 258.8 |
| Solanascone | 1.0 | 32.7 |

*Total of the megastigmatrienone isomers

It can be seen that many of the substances in the extract obtained by SDE were either present in a smaller amount or were not present at all in the NVS extract.

Compounds shown in Table 1, such as megastigmatrienone, solanone and damascenone, are very important flavours and their presence in larger amounts in the SDE extract justifies the differences in flavour produced by the SDE extract as compared with that produced by the NVS extract.

Upon application of each of the extracts to tobacco products, it was found that the flavour of the extracts isolated from the tobacco through the extraction with solvents (i.e. NVS) is rather less pronounced than for the extracts isolated through the use of the SDE method described herein.

Based on these results, and without wishing to be bound by theory, it seems that the following processes may be occurring in the treatment of the tobacco in a SDE system: simple distillation, steam distillation and also degradation/steam distillation or degradation/simple distillation. Since the pH of the aqueous solution in contact with the tobacco during SDE is in the range of 5.0 to 6.0 and since the tobacco is heated up for some hours at about 100° C., degrading processes such as hydrolysis, dehydration, isomerization and simple thermal degradation may be happening. These processes, when occurring in an SDE system, may generate products with characteristics distinct from the ones obtained in closed systems.

Without wishing to be bound by theory, in closed systems, for example, the tendency is to obtain the most stable products and volatile substances naturally found in tobacco, or generated from it, have as many chances of undergoing chemical reactions as the least volatile ones. In SDE systems, volatile substances have fewer chances of being transformed because they are quickly removed. Therefore, relatively unstable compounds, or even intermediates of degrading processes, may be isolated.

Comparative Example 2—Comparison of SDE Carried Out at pH 6.0 and pH 2.0

In order to demonstrate the advantages of using a pH of no greater than 2 in the SDE method, the extracts obtained from SDE using a pH value of 2.0 and a pH value of 6.0 were evaluated and compared.

The method of Example 1 was carried out using Virginia tobacco as the tobacco material at a pH of 2.0 (as described above) and also at a pH of 6.0 by using different amounts of HCl (e.g., 1 mL of HCl 37% to achieve pH lower than 2) in order to vary the pH of the procedure. The extracts thus obtained were separated by gas chromatography and their chromatograms compared.

Figure 6:
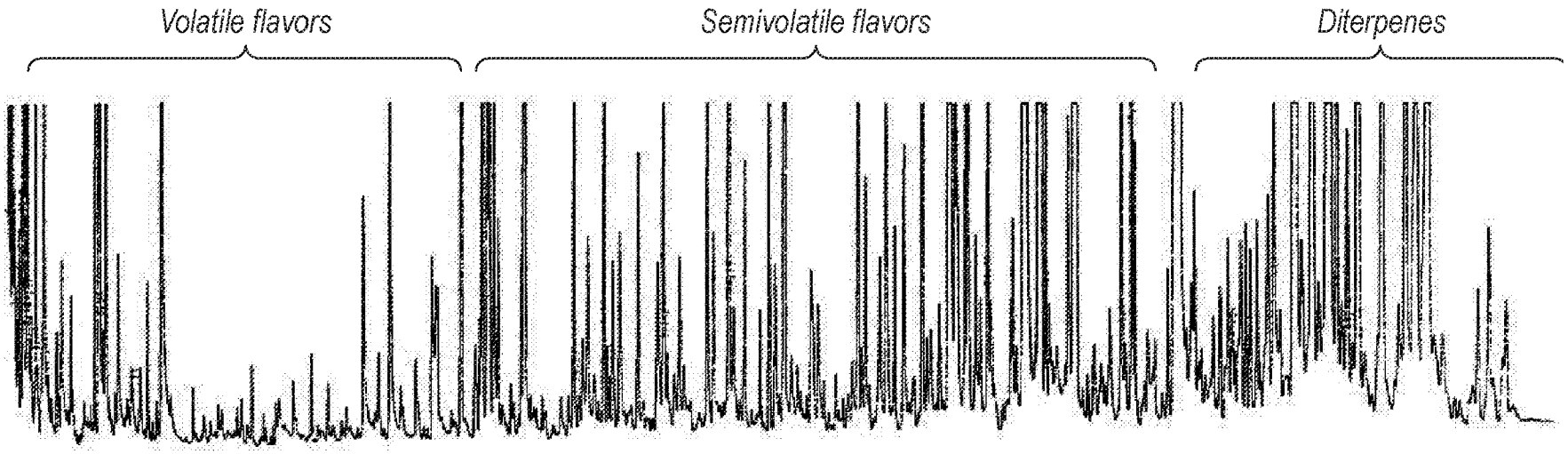
FIG. 6 is a reference Figure that shows an example chromatogram in which the peaks are separated into three groups: volatile flavours, semi-volatile flavours, and diterpenes. This Figure is included for ease of interpretation only.

For reference, an exemplary chromatogram is shown in FIG. 6, which separates the peaks of the chromatogram into three groups: volatile flavours, semi-volatile flavours and diterpenes. It is noted that FIG. 6 is for reference only, and is to be used for interpretation of the peaks of the chromatograms shown herein.

Figure 7:
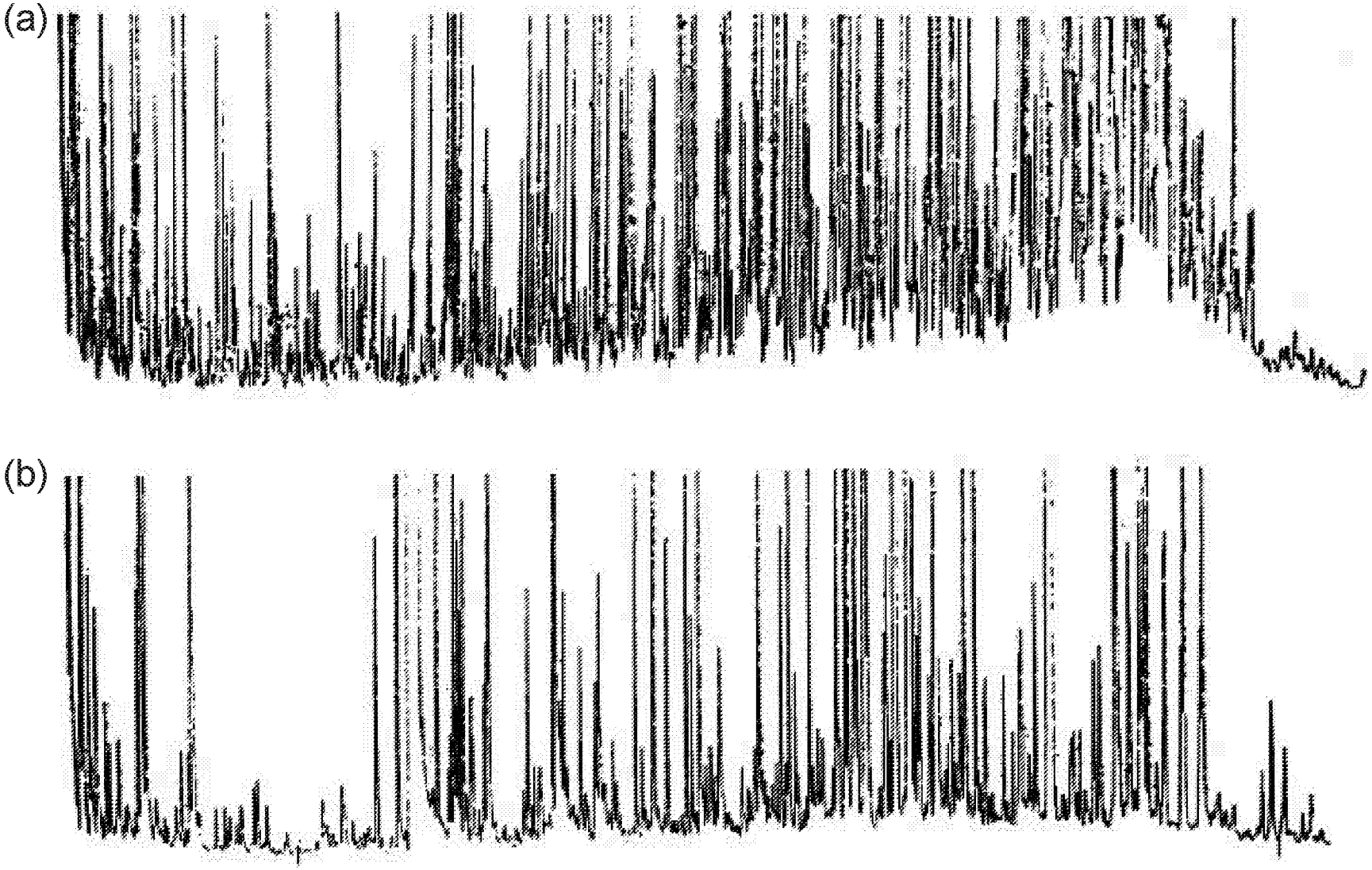
FIG. 7 shows the chromatograms obtained using the simultaneous distillation-extraction method at (a) pH 2.0 (in accordance with the invention) and (b) pH 6.0 (outside the scope of the invention).
Figure 8:
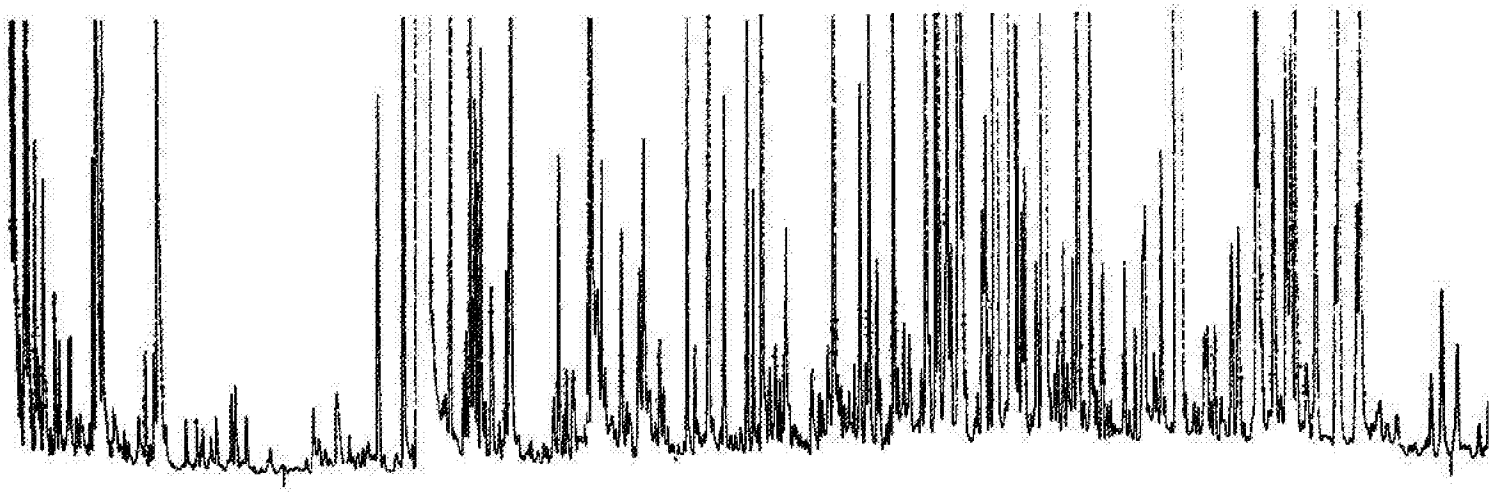
FIG. 8 shows the chromatogram obtained using the simultaneous distillation-extraction method at pH 6.0 (outside the scope of the invention).
Figure 9:
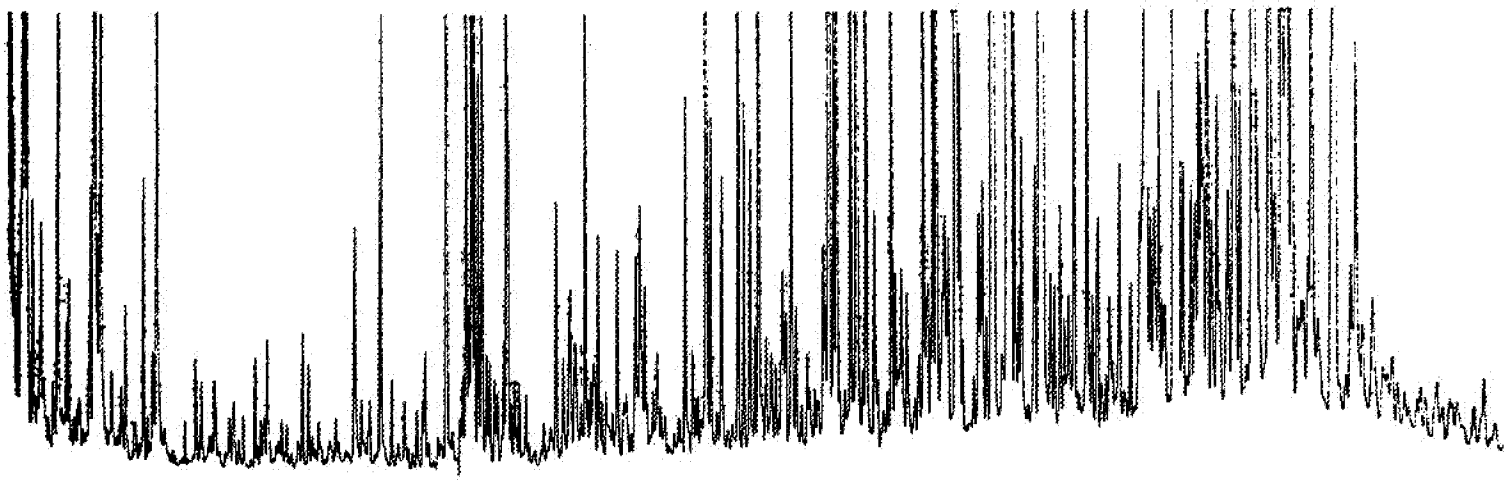
FIG. 9 shows the chromatogram obtained using the simultaneous distillation-extraction method at pH 4.0 (outside the scope of the invention).
Figure 10:
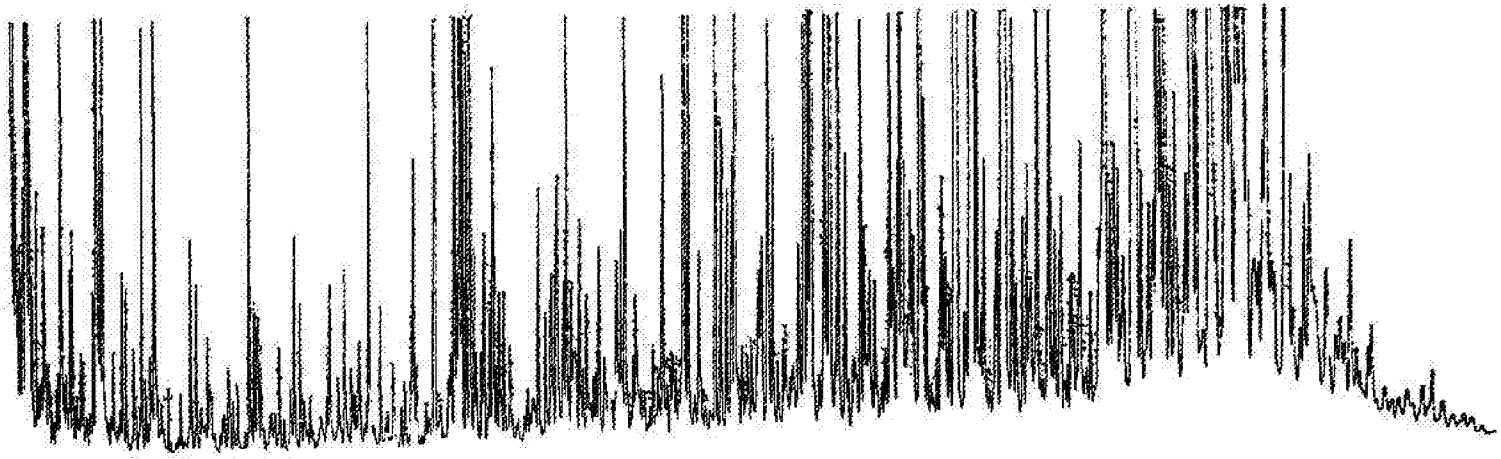
FIG. 10 shows the chromatogram obtained using the simultaneous distillation-extraction method at pH 3.0 (outside the scope of the invention).
Figure 11:
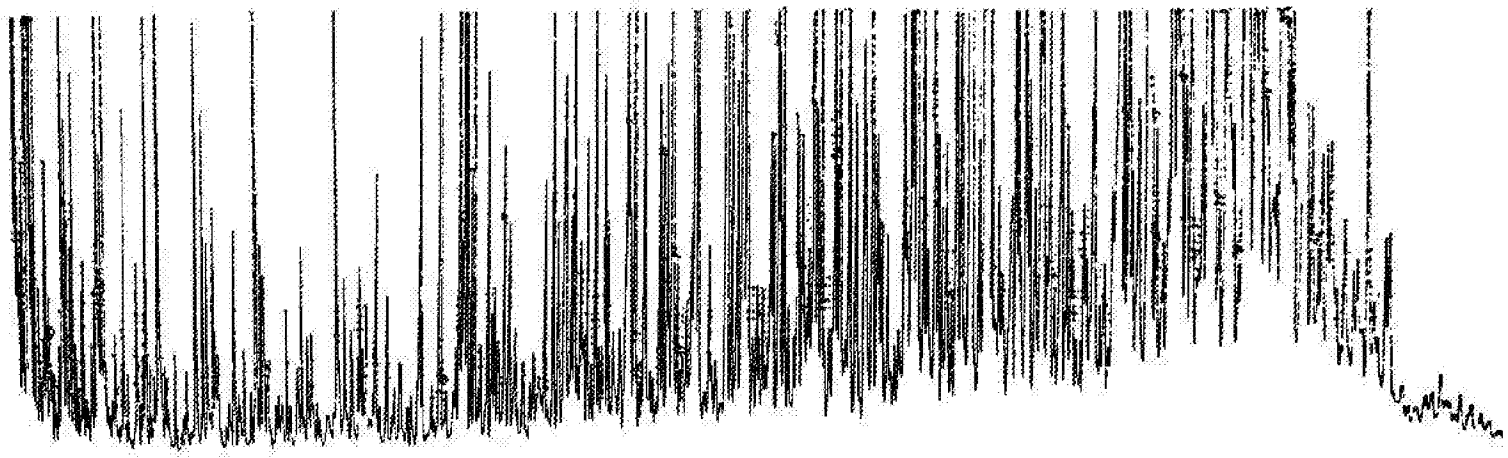
FIG. 11 shows the chromatogram obtained using the simultaneous distillation-extraction method at pH 2.0 (in accordance with the invention).
Figure 12:
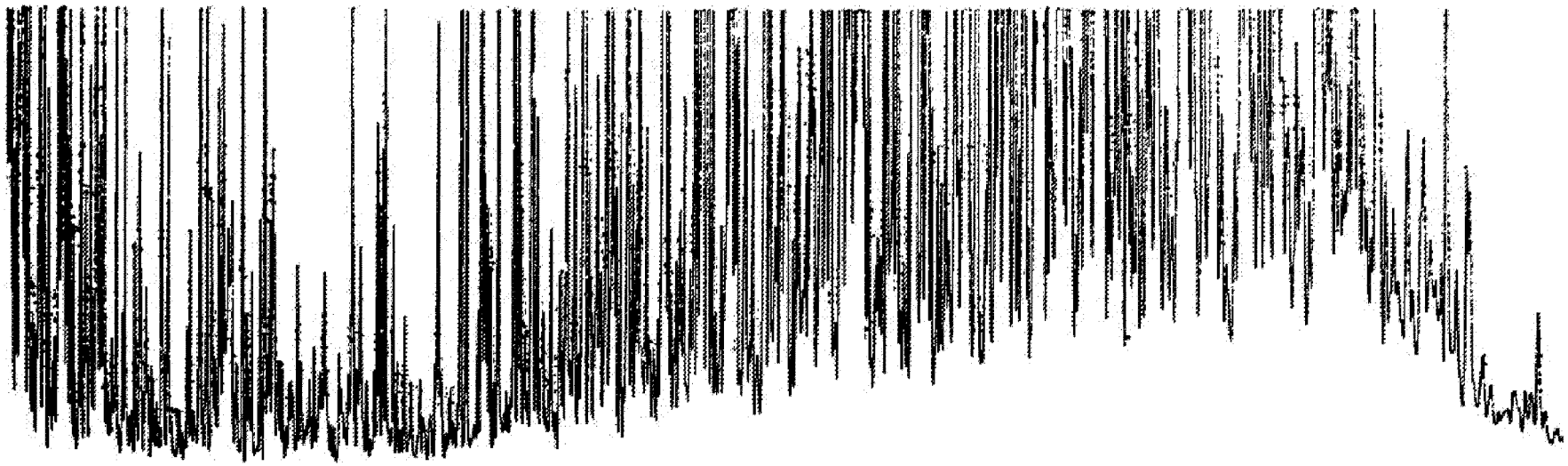
FIG. 12 shows the chromatogram obtained using the simultaneous distillation-extraction method at pH 0.5 (in accordance with the invention).

The chromatograms obtained from both SDE methods at pH=2.0 and pH=6.0 are shown in FIG. 7(*a*) and FIG. 7(*b*), respectively. As can be seen in FIG. 7, at a pH of no greater than 2, the formation of volatile compounds is rendered highly propitious as the concentration of the volatile compounds extracted at pH is significantly increased. In terms of flavour, the changes are also quite pronounced. Comparing the two extracts, it is noticed that the flavour obtained at the pH of no greater than 2 is more pronounced and, although it is still possible to identify the flavour of tobacco, a series of other notes can also be perceived.

TABLE 2 comparison of the relative areas of various peaks of flavour compounds isolated by the SDE method at pH = 6.0 and pH = 2.0 from Virginia tobacco

| Compound | pH 6.0 | pH 2.0 |
|---|---|---|
| Solanone | 83.3 | 191.8 |
| Damascenone | 7.3 | 8.7 |
| Norsolonadione | 3.0 | 8.7 |
| Megastigmatrienone* | 200.3 | 417.3 |
| Solanascone | 112.9 | 146.1 |

*Total of the megastigmatrienone isomers

The relative areas of various peaks present in the extracts obtained by SDE at pH 6.0 and pH 2.0 can be seen in Table 2, where several flavours recognized as important are shown, many of which are utilized in formulations for aromatizing tobacco. All of the flavour compounds have had their peaks increased (i.e. their concentration was higher) by the treatment at the lower pH of 2. In addition, many other compounds whose structures have not been determined as yet were also extracted in larger concentrations at pH 2.0.

In addition, a further experiment was carried out to determine the effect of carrying out the SDE method at pH 2.0 when the tobacco material is mixed with the acid several hours before SDE as compared with treating the tobacco material with acid immediately prior to SDE.

In this further experiment, the tobacco was treated with an acid solution for several hours, at about 90° C., without removing the volatile substances. Then, the acid was neutralized and the SDE carried out. The extract thus obtained presented a chemical composition different from the one obtained by submitting the tobacco to a treatment with the acid solution, simultaneously with the SDE. As an illustration, the solanone content, which is one of the compounds that have their formation increased with the treatment by SDE in acid medium, decreased in the extract obtained from the tobacco which had been treated with acid well in advance of SDE, and submitted to the SDE separately.

Comparative Example 3—Comparison of SDE Carried Out at a Range of Different pH Values In order to further demonstrate the advantages of using a pH of no greater than 2 in the SDE method, the extracts obtained from SDE using a range of pH values were evaluated and compared.

The method of Example 1 was carried out for a range of samples each using Virginia tobacco as the tobacco material in each sample, and at different pH values by varying the amount of HCl used in order to vary the pH of the procedure. Extracts obtained by SDE at pH values of 6.0, 4.0, 3.0, 2.0 and 0.5 were evaluated. The extracts thus obtained were separated by gas chromatography and their chromatograms compared.

The chromatograms obtained from the SDE methods at each of the different pH values are shown in FIGS. 8-12.

As can be seen from a comparison of each of FIGS. 8 to 12, the formation of volatile compounds is significantly increased at pH values of no greater than 2.

The extracts obtained were also tested as flavours for cigarettes. For the extracts produced using SDE at a pH of 2 or 0.5, among the sensations imparted by them to the smoke, even at very low levels of addition, are increase in amplitude, the diminishing of irritant sensations and the increase of tobacco characteristic notes according to tobacco variety used for extract production. Based on these results, it can be concluded that tobacco extracts obtained by SDE in acid conditions have the chance of becoming important from commercial point of view, making it possible, for example, the improvement of low quality tobaccos, increase the aroma of low tar cigarettes and even be used in new technologies like capsules or even in next generation products as a tobacco taste enhancer or simply to mask the undesired sensory attributes of such products.

Comparative Example 4—Comparison of SDE Carried Out for Different Periods of Time In order to demonstrate the advantages of carrying out the SDE method for a period of from about 8 to about 20 hours, the extracts obtained from SDE over a range of time periods were evaluated and compared.

The SDE method described in Example 1 was performed, but for a total period of 5 hours rather than the 9 hours of Example 1. As the skilled person will appreciate, 5 hours is generally regarded as being the standardized period of time for the extraction in the SDE method for the analysis of the tobacco.

It was found by the present inventors that this period of 5 hours was not sufficient for the quantitative removal of the volatile compounds. In contrast, the SDE carried out for a period of 9 hours produced flavour compounds in higher concentrations, thus providing enhanced flavour. The results obtained in this study have indicated that the period of time of SDE in acid medium significantly influences the extracts chemical composition.

Regarding the importance in organoleptic terms of the compounds isolated after a long period of time (i.e. at least about 8 hours) of SDE in acid medium, it was found that at least some of them are capable of contributing to the smoke/vaping quality.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of appropriate combinations of the disclosed elements, components, features, parts, steps, means, etc., other than those specifically described herein. In addition, this disclosure may include other inventions not presently claimed, but which may be claimed in the future.

The invention claimed is:

1. A method of extracting one or more volatile compounds of interest from tobacco material, the method comprising the steps of:

i) providing tobacco material;

ii) subjecting the tobacco material to steam distillation; and iii) extracting one or more volatile compounds of interest from the tobacco material with a solvent, wherein the solvent is a mixture of pentane and diethyl ether;

wherein distillation step (ii) and extraction step (iii) are carried out simultaneously and at a pH of no greater than 2, and wherein the period during which both the distillation step (ii) and the extraction step (iii) are carried out is from about 8 to about 20 hours.

2. The method according to claim 1, wherein the distillation step (ii) and extraction step (iii) are carried out at a pH of no greater than 2 for the total period of time for which said steps are carried out.

3. The method according to claim 1, wherein the solvent comprises a mixture of pentane and ethyl ether in a weight ratio of pentane to ethyl ether of 3:1 to 1:1.

4. The method according to claim 1, wherein the distillation step (ii) and extraction step (iii) are carried out at a pH of from 0.5 to 2.

5. The method according to claim 1, wherein the period during which both the distillation step (ii) and the extraction step (iii) are carried out is from about 8 to about 10 hours.

6. The method according to claim 1, wherein the distillation step (ii) and the extraction step (iii) are carried out at a temperature of up to about 130° C.

7. The method according to claim 1, wherein the tobacco material does not undergo any heat treatment before distillation step (ii) and extraction step (iii) are carried out.

8. The method according to claim 1, wherein the one or more volatile compounds of interest are selected from the group consisting of: sugars, sugar esters, amino acids, beta-carotene, violaxanthin, lutein, neoxanthin, phytol, labdanoids, cembranoids, polyphenols, lignin and mixtures thereof.

9. The method according to claim 1, wherein the method further comprises a purifying step which comprises replacing the solvent used for extraction with another solvent suitable for use in a tobacco product.

10. The method according to claim 9, wherein the solvent suitable for use in a tobacco product is ethanol.

* * * * *